US008550605B2

(12) United States Patent
Higa

(10) Patent No.: US 8,550,605 B2
(45) Date of Patent: Oct. 8, 2013

(54) CHANNEL MEMBER, INKJET HEAD STRUCTURE AND INKJET RECORDING DEVICE

(75) Inventor: Takehisa Higa, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 340 days.

(21) Appl. No.: 12/742,419

(22) PCT Filed: Nov. 12, 2008

(86) PCT No.: PCT/JP2008/070618

§ 371 (c)(1),
(2), (4) Date: May 11, 2010

(87) PCT Pub. No.: WO2009/063922

PCT Pub. Date: May 22, 2009

(65) Prior Publication Data

US 2010/0253751 A1 Oct. 7, 2010

(30) Foreign Application Priority Data

Nov. 12, 2007 (JP) ..... 2007-292990

(51) Int. Cl.
*B41J 2/175* (2006.01)

(52) U.S. Cl.
USPC ..... 347/85; 428/137; 347/74

(58) Field of Classification Search
USPC ..... 347/85, 20, 44, 68–72; 428/137
See application file for complete search history.

(56) References Cited

U.S. PATENT DOCUMENTS

| | | | | |
|---|---|---|---|---|
| 5,818,482 | A * | 10/1998 | Ohta et al. | 347/70 |
| 5,908,682 | A * | 6/1999 | Nanataki et al. | 428/138 |
| 6,209,994 | B1 * | 4/2001 | Furuhata et al. | 347/68 |
| 7,232,202 | B2 | 6/2007 | Kinparu | 347/20 |
| 8,020,967 | B2 * | 9/2011 | Hiwada | 347/44 |
| 2006/0209139 | A1 * | 9/2006 | Murata | 347/71 |

FOREIGN PATENT DOCUMENTS

| | | |
|---|---|---|
| JP | 11-078021 | 3/1999 |
| JP | 11348302 A | 12/1999 |
| JP | 2003-175607 | 6/2003 |
| JP | 2003-326725 | 11/2003 |
| WO | WO 03/049951 A1 | 6/2003 |

* cited by examiner

*Primary Examiner* — Ellen Kim
(74) *Attorney, Agent, or Firm* — DLA Piper LLP (US)

(57) ABSTRACT

Provided is a channel member having a channel which penetrates from one main surface to the other main surface. The channel is formed with its diameter increased toward the other main surface from the one main surface. A parallel section which is substantially parallel to the other main surface and is exposed to the other main surface is provided on the inner surface of the channel.

6 Claims, 11 Drawing Sheets

CHANNEL MEMBER, INKJET HEAD STRUCTURE AND INKJET RECORDING DEVICE

CROSS-REFERENCE TO THE RELATED APPLICATIONS

This application is a national stage of international application No. PCT/JP2008/070618 filed on Nov. 12, 2008, and claims the benefit of priority under 35 USC 119 to Japanese Patent Application No. 2007-292990 filed on Nov. 12, 2007, the entire contents of which are incorporated herein by reference.

TECHNICAL FIELD

The present invention relates to a channel member, an inkjet head structure and an inkjet recording device.

BACKGROUND ART

Conventionally, for example an inkjet type recording device is used as means for printing texts and images on a recording paper. In recent years, along with higher precision of image output, higher density of printing is increasingly required. An inkjet head structure to be installed in the inkjet type recording device has a pressurization mechanism for discharging and flying an ink droplet toward the recoding paper with utilizing thermal energy generated from heat generation resistors, utilizing deformation of piezoelectric elements, further utilizing heat generated in accordance with radiation of electromagnetic waves, or the like. The inkjet head structure is generally provided with a channel member for guiding ink from an ink tank to the pressurization mechanism.

One example of a conventional channel member is described in Japanese Unexamined Patent Publication No. 2003-175607, for example.

For example, in a case where a channel member as described in Japanese Unexamined Patent Publication No. 2003-175607 is manufactured, the channel member obtained after baking a compact sometimes has relatively low size precision of an opening on the outlet side. The present invention is achieved in consideration with the above problem.

DISCLOSURE OF THE INVENTION

In consideration with the above, the present invention is to provide a channel member having a channel penetrating from a first main surface to a second main surface, wherein a diameter of an opening on the side of the second main surface of the channel is larger than a diameter of an opening on the side of the first main surface of the channel, and an inner surface of the channel has a parallel section which is substantially parallel to the first main surface and exposed to the side of the second main surface.

The present invention is also to provide an inkjet head structure, including a pressurization mechanism arranged on the side of the second main surface of the channel member, the pressurization mechanism being adapted to pressurize ink supplied via the channel member, and an ink discharge port adapted to discharge the pressurized ink.

The present invention is also to provide an inkjet recording device, including the inkjet head structure, an ink tank adapted to accommodate the ink to be supplied to the channel of the channel member, and a conveyance mechanism adapted to convey a recording medium in such a way that the recording medium faces the ink discharge port.

DESCRIPTION OF REFERENCE NUMERALS

Figure 1:
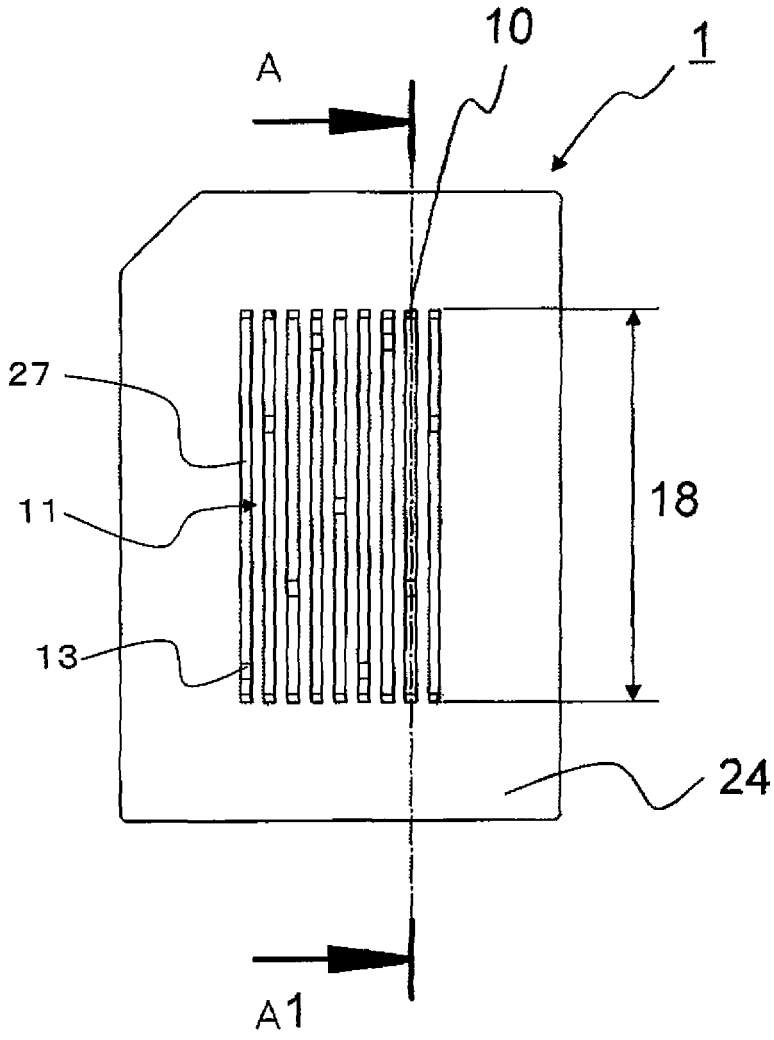
FIG. 1 is a plan view of a channel member according to one embodiment of the present invention.

1, 101 Channel member
2, 102 Recording element substrate
3, 103 Nozzle plate
4, 104 Inkjet head structure
5, 42, 105 Channel section
6, 106 Ink discharge port
7, 107 Heat generation resistor
9 Pressurization mechanism
10, 57 Channel
21 Through hole
13, 54 Small hole
18, 118 Channel length
22 One main surface
24 Other main surface
26, 56 Inclination section,
27, 57 Opening
32 Parallel section
33, 35 Concave curve
34 Wall surface section

BEST MODES FOR CARRYING OUT THE INVENTION

A channel member of the present invention and an inkjet head structure using the same are described below.

Figure 2A:
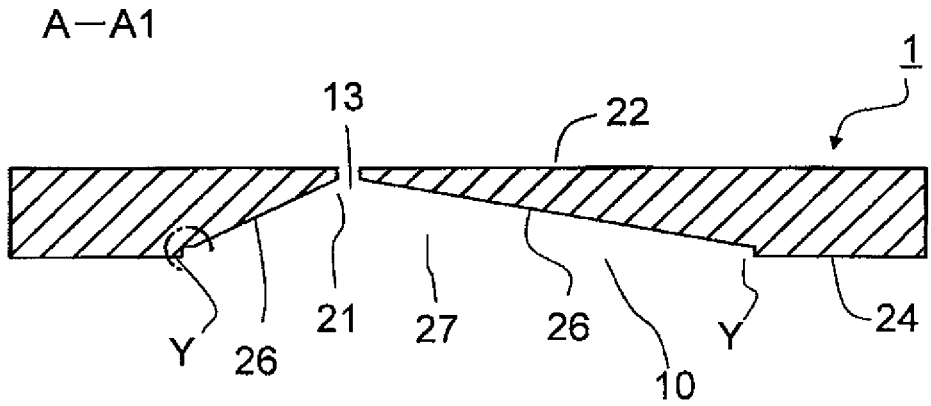
FIG. 2A is a sectional view of the channel member shown in FIG. 1.

FIG. 1 is a plan view of a ceramic channel member according to one embodiment of the present invention. FIG. 2A is a sectional view taken along line A-A1 of the channel member in FIG. 1, and FIGS. 2B and 2C are enlarged sectional views of a Y part of FIG. 2A.

A channel member 1 of the present embodiment is a plate body such as rectangular plate. A small hole 13 is provided on the side of a first main surface 22 of the channel member 1, and a channel 10 is formed to extend from this small hole 13 to a long opening 27 provided on a second main surface 24. An inclination section 26 is provided on an inner surface of the channel 10, and a diameter of the channel 10 is increased along one direction from the side of the first main surface 22 to the side of the second main surface 24. A diameter of the opening 27 on the side of the second main surface 24 of the channel 10 is larger than a diameter of the small hole 13 on the side of the first main surface 22 of the channel 10. In the present embodiment, the diameter of the opening 27 indicates a diameter along the longitudinal direction of the opening 27. It should be noted that a diameter along the short direction of the opening 27 may be larger than the diameter of the small hole 13 along this short direction.

The channel member 1 of the present embodiment has a parallel section 32 which is substantially parallel to the second main surface 24 and exposed to the side of the second main surface 24 on the inner surface of the channel 10. The exposure to the side of the second main surface 24 indicates a state that the parallel section 32 is visible when seen in a plan view from the direction substantially vertical to the second main surface 24. A plurality of the channels 10 is provided in one channel member 1, and the channels 10 are respectively separated from each other by partition walls 11. The inner surface of the channel member 10 has a wall surface section 34 which is vertical to the second main surface 24 and the parallel section 32 which is continuous to the wall surface section 34 and substantially parallel to the other main surface 24 in the vicinity of both edges of the opening 27. The parallel section 32 is more parallel to the second main surface 24 than the inclination section 26.

Figure 2B:
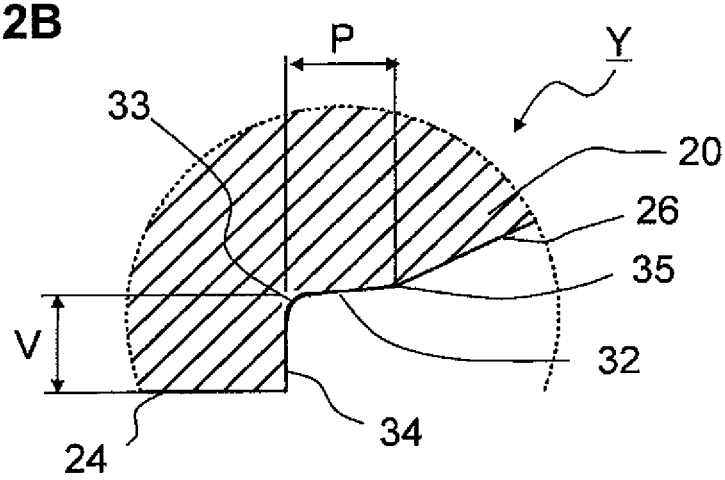
FIGS. 2B and 2C are partially enlarged sectional views of FIG. 2A.
Figure 2C:
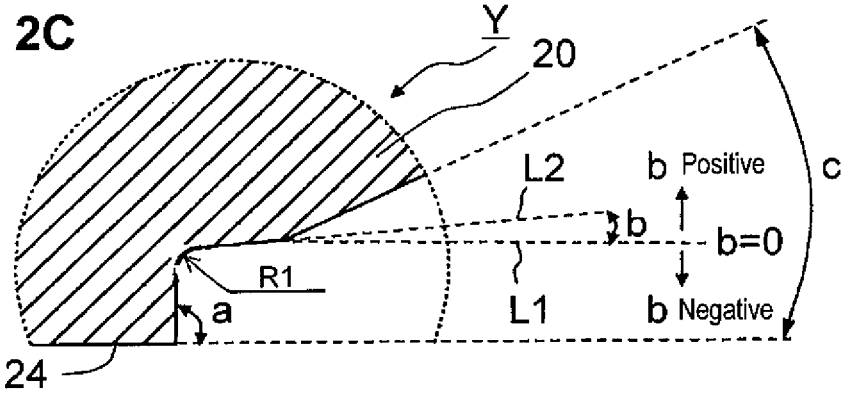

FIG. 2A shows two Y parts, and FIGS. 2B and 2C are enlarged views of the Y part on the left side of FIG. 2A. The inner surface of the channel member 10 has the wall surface section 34, the parallel section 32, and the inclination section 26 also in the Y part on the right side.

Figure 3A:
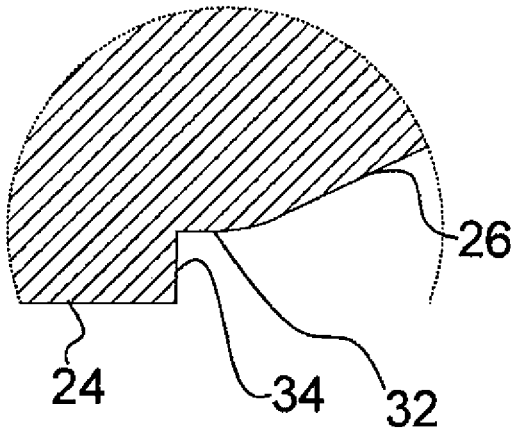
FIGS. 3A and 3B are partially enlarged sectional views of the channel member shown in FIG. 1.
Figure 3B:
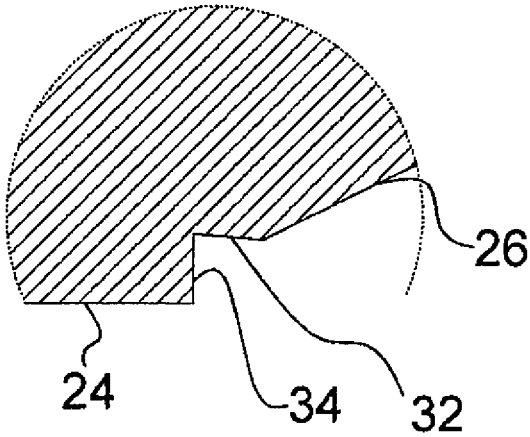

An angle between the wall surface section 34 and the other main surface 24 is expressed as a, an angle between the parallel section 32 and the other main surface 24 is expressed as b, and an angle between the inclination section 26 and the other main surface 24 is expressed as c. A relationship thereof is a>c>b by absolute values in the channel member 1. In FIG. 2C, the angle b is illustrated as an angle between a plane which is parallel to the other main surface 24 (a dot line L1) and a plane which is parallel to the parallel section 32 (a dot line L2). It should be noted that a shape of the Y part is not limited to a shape shown in FIG. 2B. For example, a corner portion of the parallel section 32 and the inclination section 26 may be round as in FIG. 3A, or an angle between the parallel section 32 and the wall surface section 34 may be acute as in FIG. 3B. It should be noted that the angle between the wall surface section 34 and the other main surface 24 is an angle made by a cut line of cutting by the second main surface 24.

A ceramic sintered compact such as an alumina sintered compact, a zirconia sintered compact, a silicon nitride sintered compact, a silicon carbide sintered compact, a mullite sintered compact, a forsterite sintered compact, a steatite sintered compact, and a cordierite sintered compact, or a single crystalline sapphire can be used as a ceramic material forming the channel member 1. The channel member is preferably made of the alumina sintered compact which allows the most inexpensive manufacture among these.

Figure 4A:
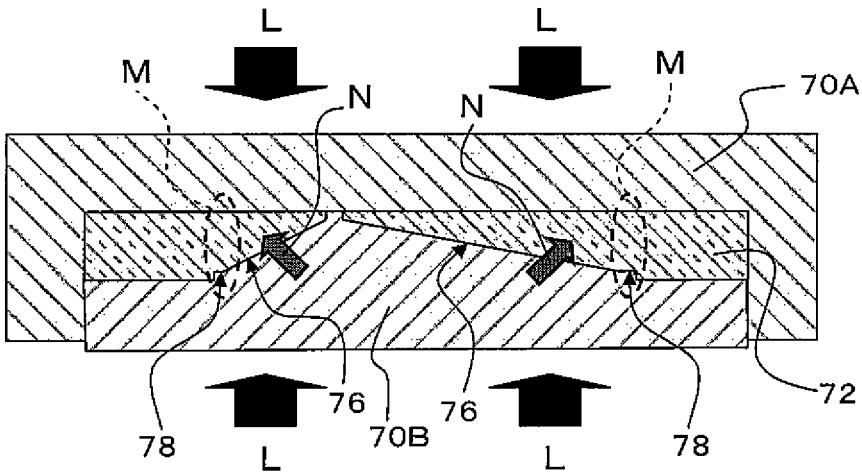
FIG. 4A is a schematic sectional view illustrating a manufacturing method of the channel member according to the one embodiment of the present invention.
Figure 4B:
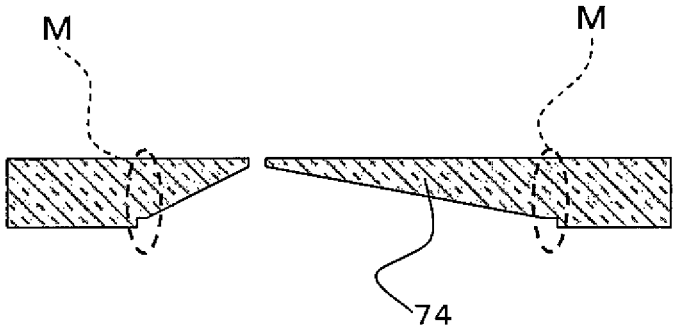
FIGS. 4B and 4C are partially enlarged sectional views of FIG. 4A.
Figure 4C:
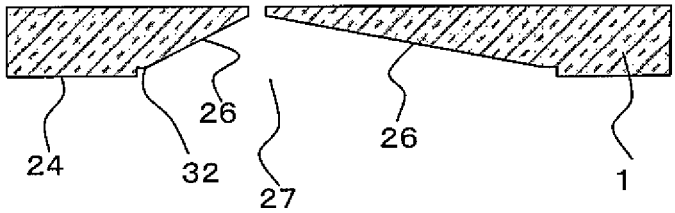

FIG. 4 is a schematic sectional view illustrating a manufacturing method of the channel member 1 according to the one embodiment of the present embodiment. Firstly, as shown in FIG. 4A, ceramic material powder 72 is press-molded by molds 70A and 70B. At this time, surface roughness of the molds corresponding to parts which form the small hole 13 is for example 0.05 or less by arithmatic average roughness (Ra), and uniaxial press-molding is performed with molding pressure of for example 60 to 100 MPa. By this press-molding, a compact 74 as shown in FIG. 4B is obtained. After this, this compact 74 is baked at a temperature of for example 1500 to 1800° C. so as to obtain the channel member 1 shown in FIG. 4C.

In the present embodiment, pressure (shown by arrows L in the figure) is added to the ceramic material powder 72 filled in the molds so that the material powder 72 is sandwiched from the side corresponding to the one main surface 22 and the side corresponding to the other main surface 24. The channel member 10 of the channel member 1 to be manufactured has the wall surface section 34 which is vertical to the other main surface 24 and the parallel section 32 which is continuous to the wall surface section 34 and substantially parallel to the other main surface 24 in the vicinity of the both edges of the opening 27. The mold 70B also has a shape to fit with a shape of this channel member 1 to be manufactured.

In the present embodiment, the pressure added from the molds to the material powder is applied substantially vertically to a parallel part 78 corresponding to the parallel section 32 at a part M corresponding to the vicinity of the both edges of the opening 27. A loss of the pressure applied to this part M is relatively small. Therefore, the compact 74 shown in FIG. 4B has relatively small variation in density of ceramic particles forming the material powder 72 and relatively high density at the part M.

At the time of the press-molding, pressure dispersion as illustrated by arrows N in the figure is easily caused in a sloping part 76 corresponding to the inclination section 26. Therefore, part of the ceramic particles (not shown) forming the material powder 72 is relatively easily moved in the vicinity of the sloping part 76 due to the dispersed pressure.

In the present embodiment, at the time of press-molding, sufficient pressure is applied to the ceramic particles forming the material powder 27 at the part M corresponding to the vicinity of the both edges of the opening 27 as described above. Therefore, movement of the ceramic particles in the direction other than the pressure-application direction by pressing (the direction of the arrows L in the figure) is suppressed at the part M. In the present embodiment, at the time of press-molding, movement of the ceramic particles from the sloping part 76 is also suppressed at the part M (that is, a part to which the pressure is sufficiently applied). As a result, the compact 74 obtained in the present embodiment and shown in FIG. 4B has relatively small variation in the density of the ceramic particles.

Meanwhile, in a case where the press-molding is performed with molds corresponding to a conventional channel member as shown in FIGS. 12(*a*) and 12(*b*) for example, the ceramic particles forming the material powder are relatively easily and freely moved by the pressure dispersion at the sloping part at the time of press-molding. In this case, the density of the ceramic particles in the compact tends to vary relatively largely. In a case where the compact in a state that the density of the ceramic particles varies is baked, deformation in accordance with this density variation is relatively easily caused at the time of baking. In this case, a shape of the channel member after baking is relatively largely different from the shape corresponding to the molds. Meanwhile, in the present embodiment, the compact 74 obtained by press-molding has relatively small variation in the density of the ceramic particles. In the present embodiment, it is possible to obtain the channel member 1 having the shape corresponding to the shape of the molds with relatively high precision shown in FIG. 4C.

In the present embodiment, since the parallel section 32 is provided, it is possible to apply sufficiently large pressure to the part M and relatively increase the density of the ceramic particles at the Y part. The channel member 1 of the present embodiment has for example relatively less open pores at the Y part and relatively high corrosion resistance against ink. In the channel member 1, the angle b between the other main surface 24 and the parallel section 32 is preferably 20° or less. In this case, upon manufacture of the channel member 1, it is possible to relatively increase green density at a point corresponding to the Y part and relatively increase size precision of the channel member 1.

The channel member 1 has a concave curve 33 provided between the parallel section 32 and the wall surface section 34 on the inner surface of the channel 10. A curvature radius R of the concave curve 33 is preferably within a range from 0.05 to 1 mm. Thereby, it is possible to further enhance the size precision of the channel member 1, particularly the size precision of the long hole 27.

Figure 5:
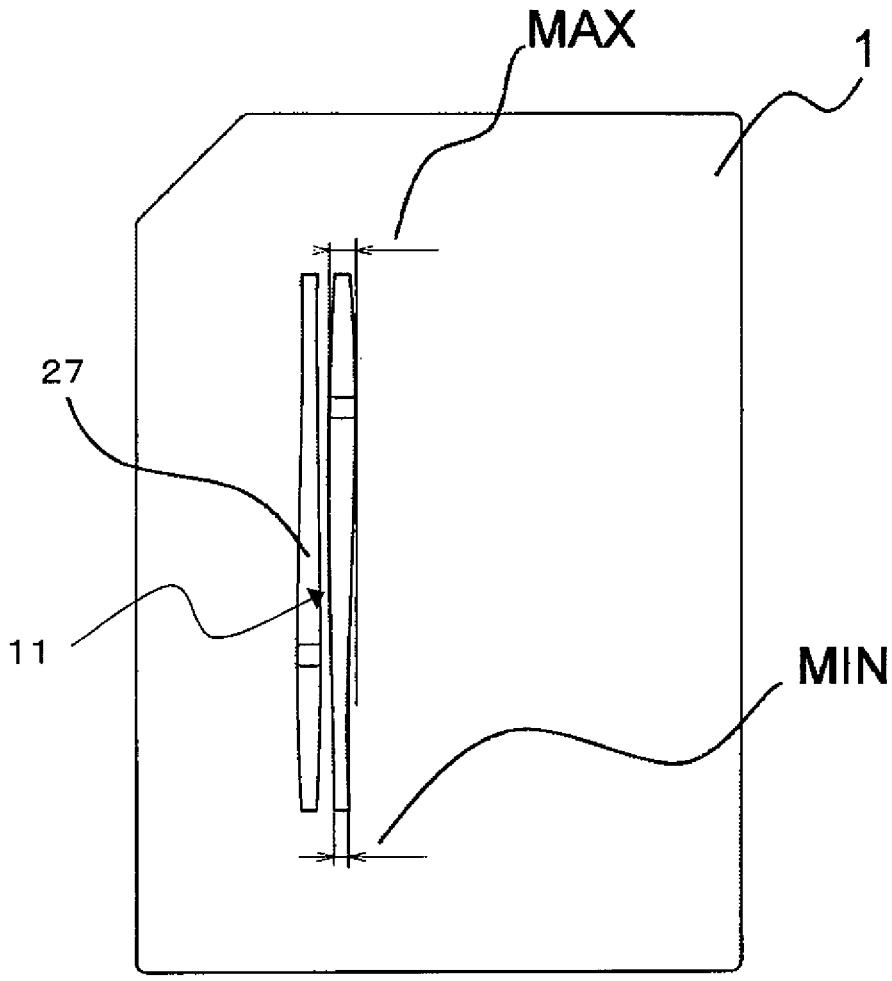
FIG. 5 is a plan view showing a measuring method of a slot deformation amount of the channel member.

The partition wall 11 for separating the channels 10 has relatively small width, and deformation is relatively easily caused in accordance with distribution of the green density at the time of baking the channel member 1. However, this partition wall 11 and the opening 27 of the channel 10 are also formed with relatively high size precision in the channel member 1. Quality of the size precision of the channel member 1 can be evaluated by a method shown in FIG. 5. FIG. 5 is a plan view of the channel member 1 observed from the direction where the opening 27 can be seen (that is, the direction which is substantially vertical to the other main surface 24). It can be said that the size precision is higher as the difference between a maximum value (MAX) and a minimum valve (MIN) of width of the opening 27 is smaller. It should be noted that FIG. 5 shows a change in a shape of the partition wall 11.

Figure 6A:
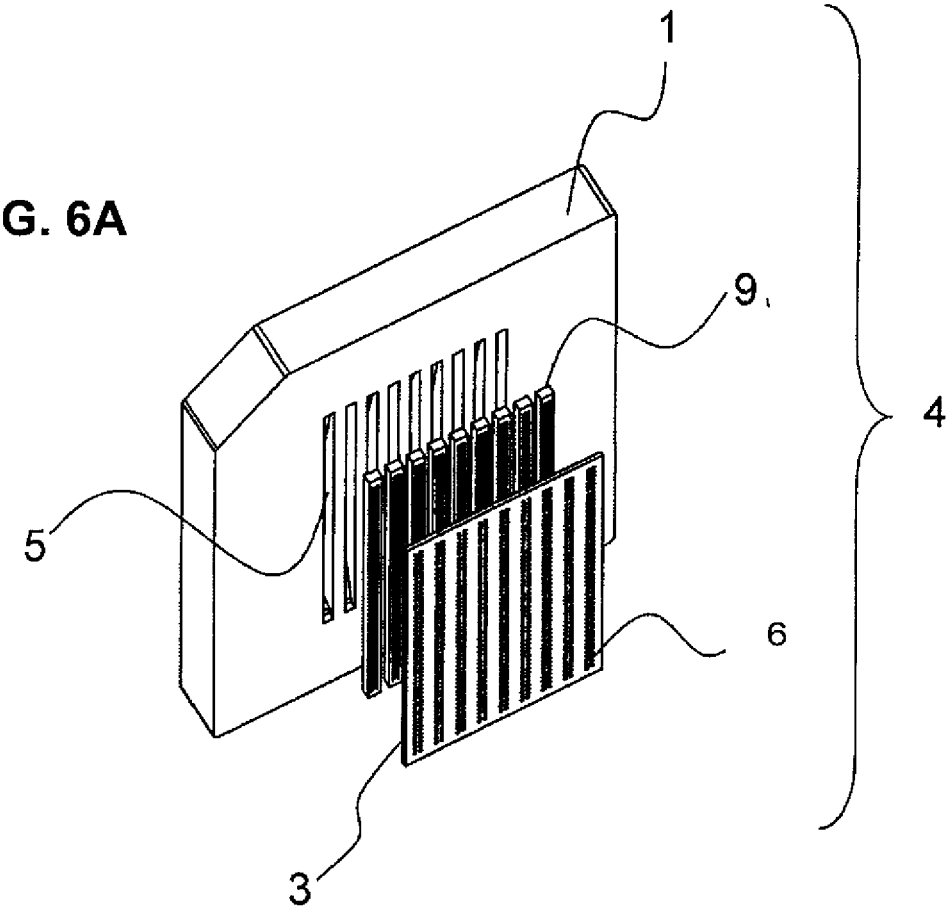
FIG. 6A is an exploded perspective view of an inkjet head structure provided with the channel member shown in FIG. 1.
Figure 6B:
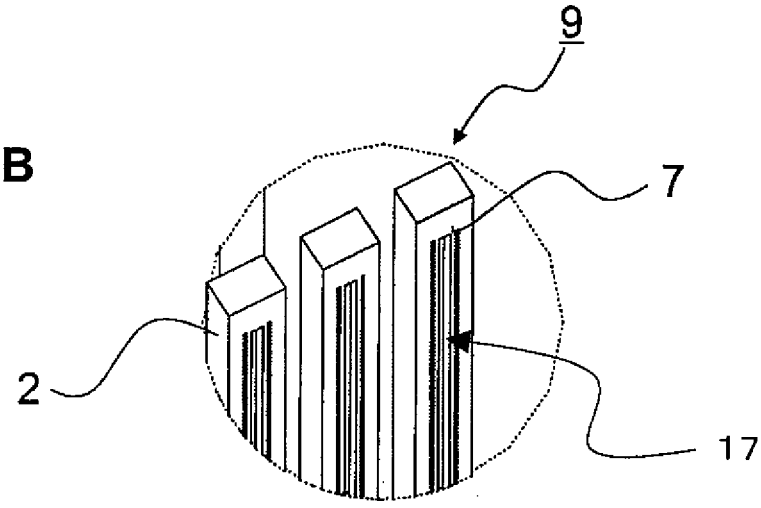
FIG. 6B is a partially enlarged perspective view of FIG. 6A.
Figure 7:
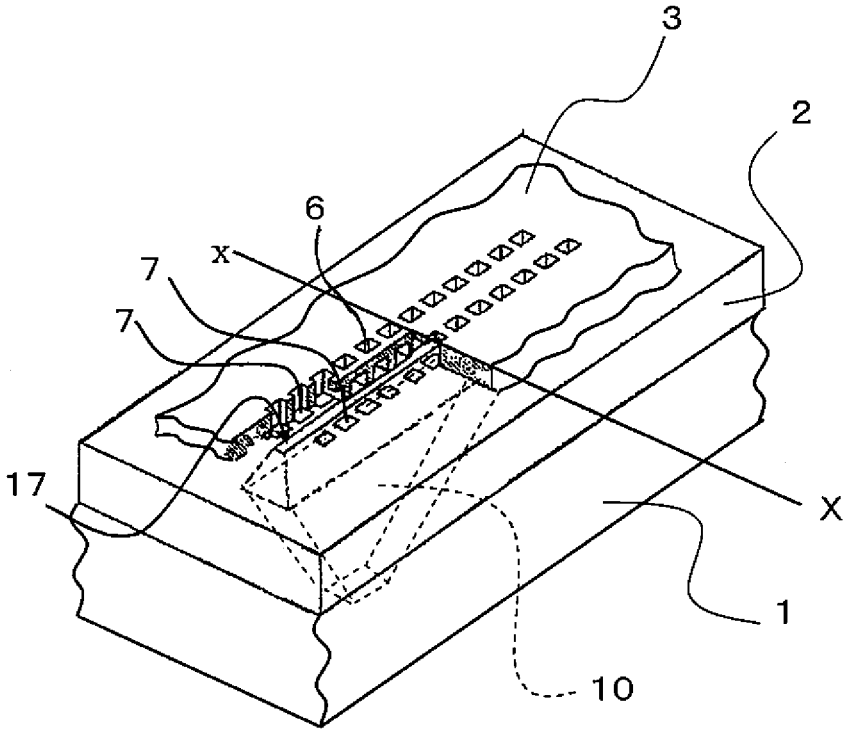
FIG. 7 is an enlarged view showing one part of FIG. 6.
Figure 8A:
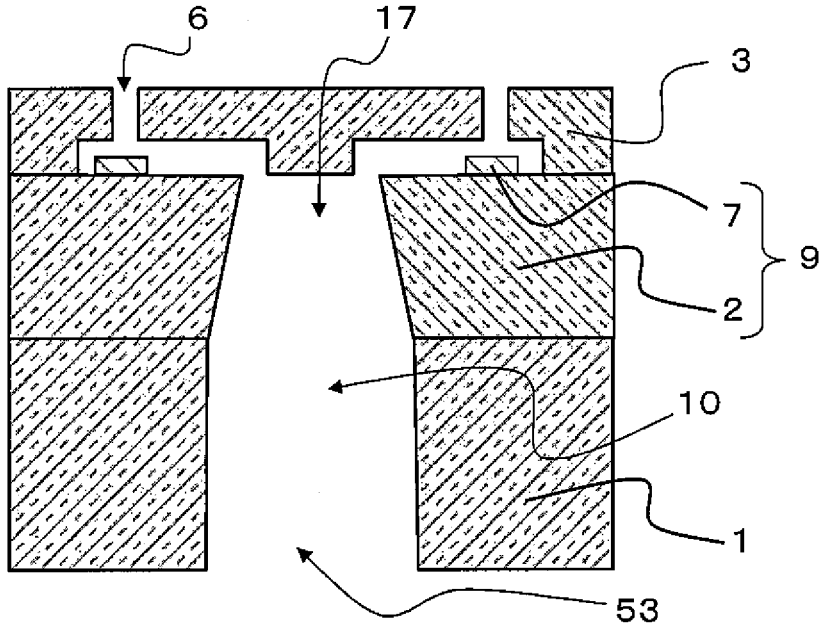
FIG. 8A is a sectional view taken along line X-X of the inkjet head structure shown in FIG. 7.
Figure 8B:
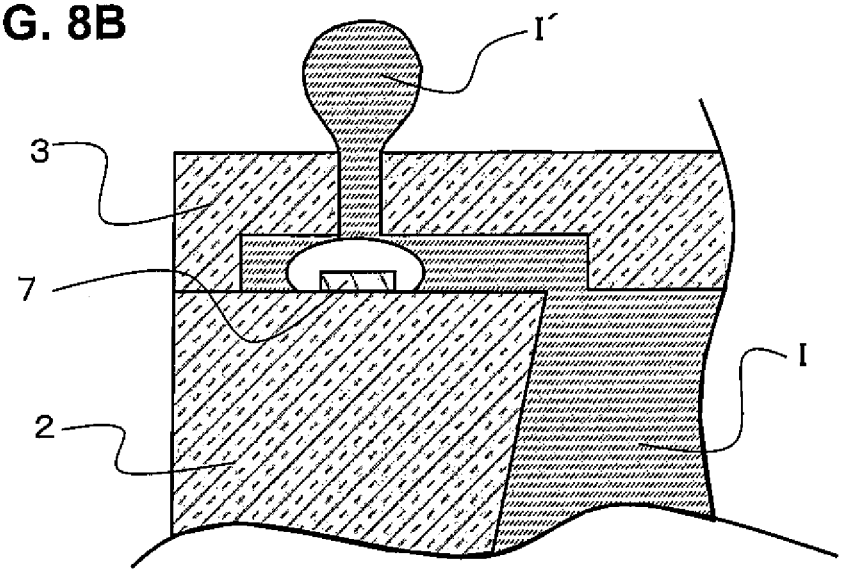
FIG. 8B is an enlarged view showing one part of FIG. 8A.

FIG. 6A is an exploded perspective view showing an inkjet head structure 4 according to the one embodiment of the present invention, and FIG. 6B is a partially enlarged perspective view of one part of FIG. GA. FIG. 7 is a partially enlarged view of the inkjet head structure 4. FIG. 8A is a sectional view taken along line X-X of the inkjet head structure 4 shown in FIG. 7, and FIG. 8B is an enlarged view of one part of FIG. 8A.

The inkjet head structure 4 of the present embodiment has the channel member 1, a nozzle plate 3, and a pressurization mechanism 9.

Here, in the pressurization mechanism 9, heat generation resistors 7 are provided in a recording element substrate 2. The recording element substrate 2 is formed by providing a long through slot 17 along one direction in a silicon substrate for example. In the pressurization mechanism 9, a plurality of the heat generation resistors 7 is aligned at predetermined intervals on the both sides of this through slot 17. The heat generation resistors 7 are connected to a wire and an electrode (not shown) so as to generate heat in accordance with an electric signal applied from the exterior.

A plurality of ink discharge ports 6 is provided in the nozzle plate 3. The channels 10 provided in the channel member 1 and the through slots 17 of the recording element substrate 2 communicate with each other. Ink I passing through the channels 10 of the channel member 1 flows to surfaces of the heat generation resistors 7 of the pressurization mechanism 9. The nozzle plate 3 and the pressurization mechanism 9 are arranged so that a plurality of the ink discharge ports 6 of the nozzle plate 3 respectively faces the heat generation resistors 7 of the pressurization mechanism 9.

FIG. 8B also shows movement of the ink I at the time of a discharge action of an ink droplet. In the inkjet head structure 4, the ink I is supplied so as to pass through the through slot 17 of the recording element substrate 2 and cover surface parts of the heat generation resistors 7 of the pressurization mechanism 9. When the heat generation resistors 7 generate heat in this state, the ink I is evaporated on the surfaces of the heat generation resistors 7 and bubbles are generated. In the inkjet head structure 4, the ink I is pressurized by these bubbles and an ink droplet I' is discharged from the ink discharge ports 6.

The inkjet head structure 4 according to the present embodiment can be installed in a device such as a printer, a copier, a facsimile machine having a communication system, and a word processor having a printer section, and further a recording device multiply combined with various processing devices.

Figure 9:
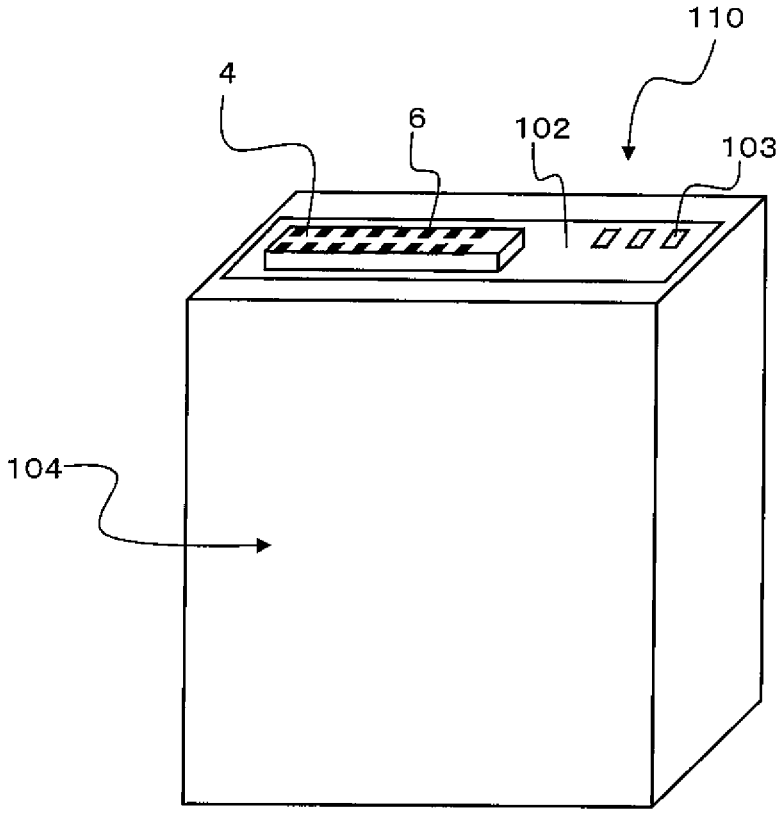
FIG. 9 is a schematic perspective view illustrating one embodiment of an inkjet cartridge provided with the inkjet head structure.

FIG. 9 is a schematic perspective view illustrating an inkjet cartridge 110 provided with the inkjet head structure 4.

The inkjet cartridge 110 is provided with an ink tank section 104 and the inkjet head structure 4. The ink is stored in the ink tank section 104, and the ink is fed from the ink tank section 104 to the channel member 1 provided in the inkjet head structure 4. In the inkjet head structure 4, the ink flows in the channels 10 of the channel member 1 through the small holes 13 of the channel member 1.

A tape member 102 having a terminal 103 for supplying the electric signal from the exterior is arranged on a surface of the inkjet cartridge 110. The wire (not shown) extending from the terminal 103 for external connection of the tape member 102 is connected to the electrode (not shown) of the inkjet head structure 4, and the ink droplet is discharged from a desired ink discharge port 6 in accordance with the electric signal applied from the exterior.

Figure 10:
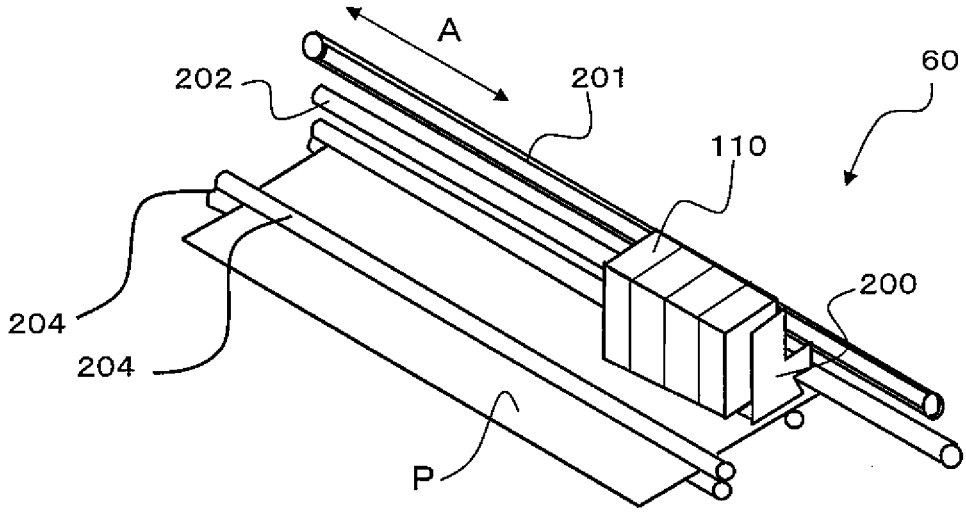
FIG. 10 is a schematic view showing a configuration example of one embodiment of an inkjet recording device provided with the inkjet cartridge shown in FIG. 9.

FIG. 10 is a schematic view showing a configuration example of one embodiment of an inkjet recording device 60 provided with the inkjet cartridge 110 shown in FIG. 9.

A carriage 200 fixed to a belt 202 is provided in the inkjet recording device 60, and the carriage 200 is main-scanned in one direction (the A direction in the figure) along a guide shaft 202. The inkjet cartridge 110 in a cartridge mode is mounted on the carriage 200. The inkjet cartridge 110 is arranged so that the ink discharge ports 6 face a paper P serving as a recording medium. The arrangement direction of the ink discharge ports 6 is different from the scanning direction of the carriage 200 (for example, the conveying direction of the paper P). It should be noted that the inkjet cartridge 110 can be provided in the number corresponding to the number of colors of ink to be used, and in the illustrated example, four inkjet cartridges are provided in correspondence with four colors (such as black, yellow, magenta and cyan). The inkjet recording device 60 is provided with a conveyance mechanism 204 having a drive roller and the like for conveying the paper P. The conveyance mechanism 204 intermittently conveys the paper P in the arrow B direction which is orthogonal to the movement direction of the carriage 200.

The ink discharge ports 6 of the inkjet head structure 4 are arranged on the lower side of the heat generation resistors 7 in the inkjet recording device 60. Therefore, with regard to the ink droplet discharged from the inkjet head structure 4, a course error of the liquid droplet due to gravity is relatively small, and the ink droplet relatively stably adheres to a desired position of the recording paper P.

Figure 11A:
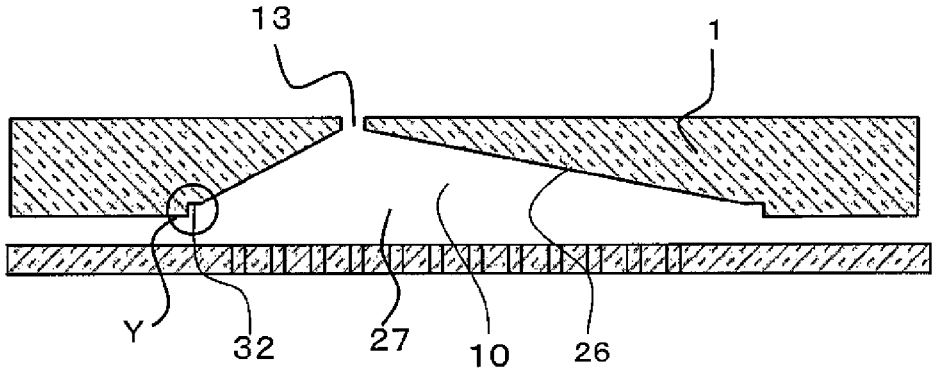
FIGS. 11A and 11B are schematic sectional views illustrating movement of bubbles in the channel of the channel member in the middle of a discharge action of an ink droplet.
Figure 11B:
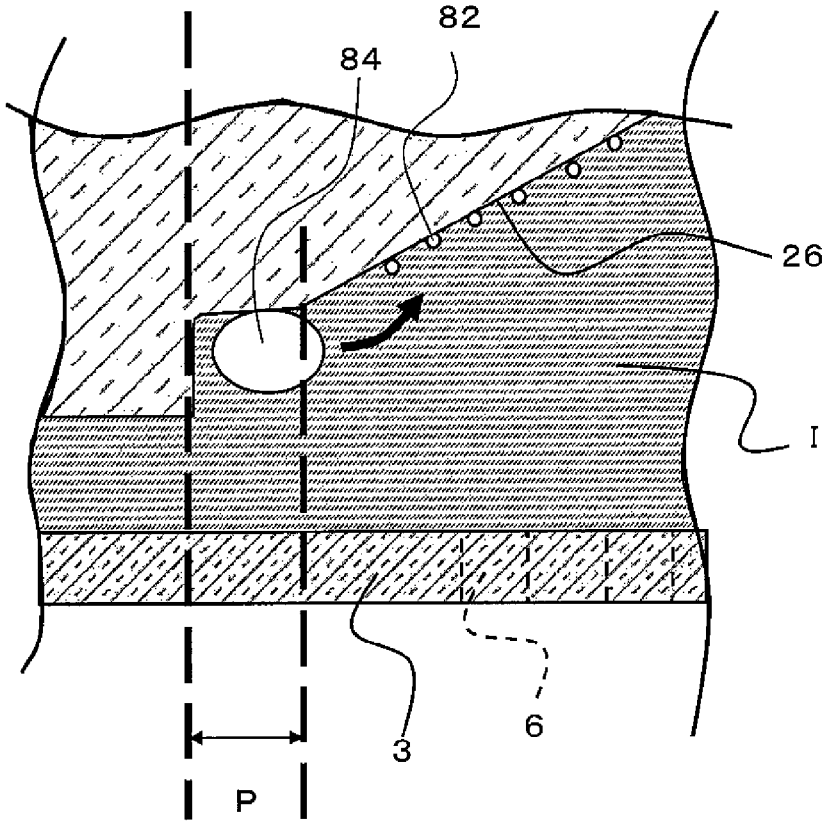

FIG. 11 is a schematic sectional view for illustrating movement of the bubbles in the channel 10 of the channel member 1 during the discharge action of the ink droplet. The ink I to be supplied to the inkjet head structure 4 is relatively easily evaporated, and sometimes evaporated in a part other than the surfaces of the heat generation resistors 7 such as the inside of the channel 10. When the ink I is evaporated in the channel 10 and the bubbles are generated, a plurality of relatively minute bubbles 82 adheres to a surface of the sloping section 26 for example. When the plural minute bubbles 82 gather together with adjacent bubbles 82 and grow to be a relatively large bubble, a pressure wave which is unnecessary for the ink I inside the channel member 1 is sometimes generated. When this pressure wave reaches the vicinity of the heat generation resistors 7 and the ink discharge ports 6 while maintaining relatively large force, a meniscus of the ink at the ink discharge ports 6 and a shape of the growing ink droplet are changed and thus an ink discharge state is sometimes changed. As described above, when a relatively large number of bubbles are adhered onto the surface of the sloping section 26, the ink discharge action is sometimes unstabilized.

In the present embodiment, the minute bubbles 82 adhered to the surface of the sloping section 26 rise along the inclination section 26 by buoyant force of the bubbles themselves. As a result, since the small hole 13 is positioned on the upper side of the opening 27, the minute bubbles 82 can relatively efficiently go through to the side of the ink tank (not shown) provided continuously to the small hole 13. Therefore, it is possible to stably discharge a predetermined amount of ink droplet.

Further, in the channel member 1 of the present embodiment, the parallel section 32 is formed in the vicinity of the both edges of the opening 27. In this parallel section 32, the rise of the generated minute bubbles 82 by the buoyant force is relatively suppressed. The vicinity of this parallel section 32 is arranged at a position relatively close to the heat generation resistors 7. Therefore, a temperature is relatively easily increased in the vicinity of the parallel section 32, and the minute bubbles 82 are easily generated in the ink I in the vicinity of this parallel section 32. Thus, in the vicinity of the parallel section 32, a relatively large number of bubbles 82 are generated in a relatively short time, and the generated bubbles 82 are combined so that a large bubble 84 is easily generated in a relatively short time.

When the large bubble 84 which has grown in a relatively short time becomes larger to an extent that the bubble runs over the parallel section 32, this bubble 84 rises along the inclination section 26 by the buoyant force thereof. At this time, the large bubble 84 efficiently goes through to the side of the ink tank (not shown) provided continuously to the small hole 13 in a relatively short time while taking in the minute bubbles 82 adhered to the surface of the inclination section 26. As described above, in the channel member 1 of the present embodiment, the relatively large bubble 84 generated in the vicinity of the parallel section 32 removes the minute bubbles 82 adhered to the surface of the inclination section 26 at relatively short time intervals. The inkjet head structure 4 of the present embodiment is to suppress the bubbles from suddenly growing in an unspecified part of the inclination section 26 and thus an excess pressure wave from being generated in the ink in the channel 10.

It should be noted that in the inkjet head structure 4 of the present embodiment, a plurality of the ink discharge ports 6 are provided along the one direction. The ink discharge port 6 on the outermost side among them is arranged closer to the center of the channel member 1 relative to the parallel section 32 of the channel 10. That is, the ink discharge ports 6 are not arranged in an area P corresponding to the parallel section 32 as shown in FIG. 10. The pressure wave in the ink I generated in accordance with the generation of the bubbles 82 and the bubble 84 in the vicinity of this parallel section 32 relatively unlikely reaches the ink discharge ports 6. In the inkjet head structure 4 of the present embodiment, an influence of the generation of the bubbles in the channel 10 over the ink discharge action is relatively small.

Since the pressure wave generated at the time of discharging the ink droplet is divided at the opening 27, it is possible to relatively stabilize the discharge action of the ink droplet. It is thereby possible to relatively shorten discharge intervals of the ink droplet so as to relatively reduce the printing time.

The present invention is not limited to the embodiment described above but deformation of piezoelectric elements may be utilized or heat generated as a result of radiation of electromagnetic waves may be utilized. It is needless to say that improvement or modification can be adapted without departing from essential gist of the present invention.

EXAMPLE 1

By the manufacturing method of the channel member described above, an alumina compact having alumina purity of 96% was molded and sintered so as to manufacture 10 samples corresponding to the channel member 1. Samples No. 1 to No. 10 respectively have an outer diameter of 28 mm×40 mm and thickness of 5 mm. The samples No. 1 to No. 10 respectively have the channel 10 provided with the small hole of 0.7 mm×1.0 mm and the opening 7 having length in the longitudinal direction of 25 mm and width of 0.7 mm. The samples No. 1 to No. 10 have different angles a, b, c shown in FIG. 2 from each other. Table 1 shows the angles a, b, c of the samples No. 1 to No. 10. It should be noted that width (P) of the parallel section 32 is 0.5 mm and length (V) of the wall surface section 34 is 0.5 mm in all the samples No. 1 to No. 10.

Table 1 shows measurement results of slot deformation amounts of respective samples No. 1 to No. 10. The slot deformation amounts of the samples No. 1 to No. 10 shown in Table 1 are average values of values obtained by measuring the differences between MAX and MIN shown in FIG. 5 for a plurality of the respective openings 7 provided in the samples. The differences between MAX and MIN of the slots were measured by using QUICK VISION PRO, a CNC vision measuring system manufactured by Mitutoyo Corporation.

Table 1 also shows results of observation on existence of cracks in the concave curved surface sections 33 of the samples No. 1 to No. 10. The existence of the cracks was determined by impregnating a flaw detection liquid into a predetermined part with a penetrant flaw detection liquid P-GIII of Marktec Corporation. In evaluations with the penetrant flaw detection liquid, "OO" indicates the sample having no cracks when observed by a 100-power microscope, "O" indicates the sample having the crack observed by the 100-power microscope, and "X" indicates the sample having the crack which was visually confirmed with naked eyes.

The results are shown in Table 1.

TABLE 1

| Sample No. | a (°) | b (°) | c (°) | Slot deformation amount (mm) | Evaluation with penetrant flaw detection liquid |
|---|---|---|---|---|---|
| 1 | 90 | −20 | 25 | 0.060 | ○ |
| 2 | 90 | −10 | 30 | 0.028 | ○○ |
| 3 | 90 | 0 | 30 | 0.035 | ○○ |
| 4 | 90 | 5 | 30 | 0.042 | ○○ |
| 5 | 90 | 10 | 30 | 0.054 | ○○ |
| 6 | 90 | 15 | 30 | 0.066 | ○○ |

TABLE 1-continued

| Sample No. | a (°) | b (°) | c (°) | Slot deformation amount (mm) | Evaluation with penetrant flaw detection liquid |
|---|---|---|---|---|---|
| 7 | 90 | 20 | 25 | 0.071 | ○○ |
| 8 | 90 | 20 | 30 | 0.083 | ○ |
| 9 | 90 | 20 | 35 | 0.093 | ○ |
| 10 | 90 | — | 30 | 0.111 | x |

The slot deformation amounts of the samples No. 1 to No. 9 are small from 0.028 mm to 0.093 mm. The evaluations with the penetrant flaw detection liquid are "O" or "OO". Particularly, the evaluations with the penetrant flaw detection liquid are all "OO" in the samples having the angles b of 20° or less.

The sample No. 10 shown in Table 1 is a sample having the same shape as the sample No. 1 except for not having the parallel section 32. With the sample No. 10, the evaluation result with the penetrant flaw detection liquid is "x", and the slot deformation amount is large.

EXAMPLE 2

Samples No. 11 to No. 20 shown in Table 2 are samples having the same shape as the sample No. 1 except for having different curvature radiuses (R1) of the concave curved surfaces 33. The curvature radiuses R1 of the samples No. 11 to No. 20 are as shown in Table 2. The evaluations with the penetrant flaw detection liquid and the evaluations of the slot deformation amounts were performed for the samples No. 11 to No. 20 as well as Example 1.

The results are shown in Table 2.

TABLE 2

| Sample No. | R1 (mm) | Slot deformation amount (mm) | Evaluation with penetrant flaw detection liquid |
|---|---|---|---|
| 11 | 0.01 | 0.021 | ○ |
| 12 | 0.03 | 0.022 | ○ |
| 13 | 0.05 | 0.025 | ○○ |
| 14 | 0.1 | 0.031 | ○○ |
| 15 | 0.3 | 0.039 | ○○ |
| 16 | 0.5 | 0.045 | ○○ |
| 17 | 0.7 | 0.051 | ○○ |
| 18 | 0.9 | 0.056 | ○○ |
| 19 | 1 | 0.063 | ○○ |
| 20 | 1.1 | 0.075 | ○ |

EXAMPLE 3

Samples No. 21 to No. 29 having the same shape as the sample No. 1 except for having different width (P) of the parallel sections 32 were manufactured and evaluated as well as Example 1.

The results are shown in Table 3.

TABLE 3

| Sample No. | P (mm) | Slot deformation amount (mm) | Evaluation with penetrant flaw detection liquid |
|---|---|---|---|
| 21 | 0.2 | 0.065 | ○ |
| 22 | 0.3 | 0.032 | ○ |
| 23 | 0.4 | 0.028 | ○ |
| 24 | 0.6 | 0.025 | ○ |
| 25 | 0.8 | 0.022 | ○ |

TABLE 3-continued

| Sample No. | P (mm) | Slot deformation amount (mm) | Evaluation with penetrant flaw detection liquid |
|---|---|---|---|
| 26 | 1.0 | 0.019 | ○ |
| 27 | 1.5 | 0.015 | ○○ |
| 28 | 2.0 | 0.013 | ○○ |
| 29 | 2.1 | 0.013 | ○○ |

With the samples having the relatively large width P, the slot deformation amounts were relatively small and the evaluation results with the penetrant flaw detection liquid were relatively favorable.

The invention claimed is:

1. An inkjet head structure, comprising: channel member comprising a ceramic sintered compact having a channel penetrating from a first main surface to a second main surface;

a pressurization mechanism arranged on the side of the second main surface of the channel member, the pressurization mechanism being adapted to pressurize ink supplied via the channel member; and a recording element substrate having a plurality of the ink discharge ports adapted to discharge the pressurized ink, the recording element substrate being arranged on the side of the second main surface, wherein an opening of the channel on the side of the second main surface has an elongated shape and a diameter of an opening of the channel on the side of the second main surface along a longitudinal direction is larger than a diameter of an opening on the side of the first main surface along said longitudinal direction, and wherein an inner surface of the channel has an inclination section being inclined such that a diameter of the channel is increased along the longitudinal direction from the side of the first main surface to the side of the second main surface, a parallel section being continuous to the inclination section, which is substantially parallel to the first main surface and exposed to the side of the second main surface, and a wall section provided between the second main surface and the parallel section and being continuous to the second main surface, the wall surface being vertical to the second main surface, and wherein a plurality of the ink discharge ports is provided in the recording element substrate along the longitudinal direction, and the parallel section of the channel is arranged on the outer side in the longitudinal direction of the ink discharge port on the outermost side along the longitudinal direction.

2. The inkjet head structure according to claim 1, wherein an angle between a virtual plane including the parallel section and the second main surface is 20° or less.

3. The inkjet head structure according to claim 1, wherein the inner surface of the channel includes a concave curve provided between the parallel section and the wall surface section.

4. The inkjet head structure according to claim 1, wherein a curvature radius of the concave curved surface is 0.05 to 1 mm.

5. The inkjet head structure according to claim 1, wherein the pressurization mechanism is provided with ink heating means adapted to heat and evaporate the ink.

6. An inkjet recording device, comprising:

an inkjet head structure according to claim 1;

an ink tank adapted to accommodate the ink to be supplied to the channel of the channel member; and a conveyance mechanism adapted to convey a recording medium in such a way that the recording medium faces the ink discharge port.

* * * * *